US006168115B1

(12) United States Patent
Abdelkhaleq

(10) Patent No.: US 6,168,115 B1
(45) Date of Patent: Jan. 2, 2001

(54) ILLUMINATED KITE SYSTEM

(76) Inventor: Bassam Abdelkhaleq, Rehoboth Beach, General Deliver, Rehoboth, DE (US) 19971

( * ) Notice: Under 35 U.S.C. 154(b), the term of this patent shall be extended for 0 days.

(21) Appl. No.: 09/186,415

(22) Filed: Nov. 5, 1998

(51) Int. Cl.[7] ..... B64C 31/06

(52) U.S. Cl. ..... 244/155 R; 362/253; 362/800; 362/806

(58) Field of Search ..... 244/153 R, 155 R; 362/253, 257, 800, 806, 249, 234; 446/47, 485; 24/129 R

(56) References Cited

U.S. PATENT DOCUMENTS 598,038 * 1/1898 Wardwell ..... 244/153 R
606,960 * 7/1898 Doyle ..... 244/153 R
800,926 * 10/1905 Mahony ..... 244/155
1,694,312 * 12/1928 Clark .
1,960,171 * 5/1934 Seeger .
3,861,626 * 1/1975 Hufstader ..... 244/153 R
4,942,506 * 7/1990 Flory ..... 244/155 R
5,043,851 * 8/1991 Kaplan ..... 362/34
5,528,476 * 6/1996 Fenton ..... 362/249

* cited by examiner

*Primary Examiner*—Galen L. Barefoot

(57) ABSTRACT

A kite illumination system is provided including a plurality of chemilluminescent light units and electrical light modules each releasably attached to the kite. The electrical light modules are preferably selectively actuated via a switch and further have uniquely colored lights which illuminate intermittently upon actuation.

5 Claims, 4 Drawing Sheets

ILLUMINATED KITE SYSTEM

BACKGROUND OF THE INVENTION

1. Field of the Invention

The present invention relates to kites and more particularly pertains to a new illuminated kite system for illuminating a kite with both chemilluminescent and electrical lights.

2. Description of the Prior Art

The use of kites is known in the prior art. More specifically, kites heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,000,402; U.S. Pat. No. 4,942,506; U.S. Pat. No. 4,715,564; U.S. Pat. No. 5,098,039; U.S. Pat. No. 1,821,465; and International Applications EP 0 358 00 and WO 93/06905 A1.

In these respects, the illuminated kite system according to the present invention substantially departs from the conventional concepts and designs of the prior art, and in so doing provides an apparatus primarily developed for the purpose of illuminating a kite with both chemilluminescent and electrical lights.

SUMMARY OF THE INVENTION

In view of the foregoing disadvantages inherent in the known types of kites now present in the prior art, the present invention provides a new illuminated kite system construction wherein the same can be utilized for illuminating a kite with both chemilluminescent and electrical lights.

The general purpose of the present invention, which will be described subsequently in greater detail, is to provide a new illuminated kite system apparatus and method which has many of the advantages of the kites mentioned heretofore and many novel features that result in a new illuminated kite system which is not anticipated, rendered obvious, suggested, or even implied by any of the prior art kites, either alone or in any combination thereof.

To attain this, the present invention is adapted for use with a kite including a sail portion having a pair of resilient linear rods coupled at central extents thereof and in perpendicular relationship. A planar flexible sheet is mounted on the linear rods for catching wind during use. The kite further includes a nylon guide string having a first end coupled to the central extents of the linear rods. The guide string depends downwardly from the sail portion for being held by a user. The kite also has a twirling assembly defined by a hemispherical chute. As shown in FIG. 1, the hemispherical chute is equipped with a peripheral edge having a plurality of nylon support strings coupled thereto and extending therefrom in a converging manner. Such support strings are coupled with an end of one of the linear rods of the sail portion. The hemispherical chute has an interior surface lined with a plurality of resilient arcuate rods coupled between the peripheral edge of the hemispherical chute and an apex thereof. During use, the twirling assembly serves to rotate about an axis associated with the resilient rod to which it is attached. As shown in FIGS. 5 & 6, a plurality of chemilluminescent light units are provided each including a flexible cylindrical container with a top face, a bottom face and a side wall for defining a closed interior space. Such interior space contains a chemilluminescent material that is activated upon the bending of the container. This may be accomplished by including a glass vial within the container. The top face of the container has a disk coupled thereto with a diameter equal to that of the container and a height about ¼ that of the container. The aforementioned disk has a diametrically disposed bore formed therein. Associated therewith is a T-shaped post fixedly coupled to a center of a top surface of the disk. In use, the guide string of the kite is adapted to be slid through the diametrically disposed bore. Thereafter, the guide string is attached about the T-shaped post for spacedly fixing the chemilluminescent light units with respect to the guide string along a length thereof. Note FIG. 6. Next provided is a plurality of electrical light modules each including a housing having a ellipsoidal configuration. The housing of each light module is halved to define a pair of halves each having an arcuate exterior surface, a planar interior surface and a periphery formed therebetween. As shown in FIG. 7, the halves are hingably coupled along first side edges of the peripheries thereof. Further included is a pair of locking couples mounted on second side edges of the peripheries thereof. Such locking couples serve for allowing the halves to be opened and closed. One of the halves of each electrical light module includes a coupling tube mounted along the exterior surface thereof. Such tube may be dimensioned and adapted for frictionally receiving the guide string, the linear rods or the arcuate rods of the kite. Each of the halves preferably have a pair of differently colored lights mounted on the planar interior surface thereof. In use, the lights of the electrical light modules are adapted for illuminating intermittently upon actuation. As shown in FIG. 7, one of the halves has a battery mounted on a central extent thereof. Coupled between the battery and the lights is a toggle switch for selectively actuating the lights.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new illuminated kite system apparatus and method which has many of the advantages of the kites mentioned heretofore and many novel features that result in a new illuminated kite system which is not anticipated, rendered obvious, suggested, or even implied by any of the prior art kites, either alone or in any combination thereof.

It is another object of the present invention to provide a new illuminated kite system which may be easily and efficiently manufactured and marketed.

It is a further object of the present invention to provide a new illuminated kite system which is of a durable and reliable construction.

An even further object of the present invention is to provide a new illuminated kite system which is susceptible of a low cost of manufacture with regard to both materials and labor, and which accordingly is then susceptible of low prices of sale to the consuming public, thereby making such illuminated kite system economically available to the buying public.

Still yet another object of the present invention is to provide a new illuminated kite system which provides in the apparatuses and methods of the prior art some of the advantages thereof, while simultaneously overcoming some of the disadvantages normally associated therewith.

Still another object of the present invention is to provide a new illuminated kite system for illuminating a kite with both chemilluminescent and electrical lights.

Even still another object of the present invention is to provide a new illuminated kite system that includes a plurality of chemilluminescent light units and electrical light modules each releasably attached to the kite. The electrical light modules are preferably selectively actuated via a switch and further have uniquely colored lights which illuminate intermittently upon actuation.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
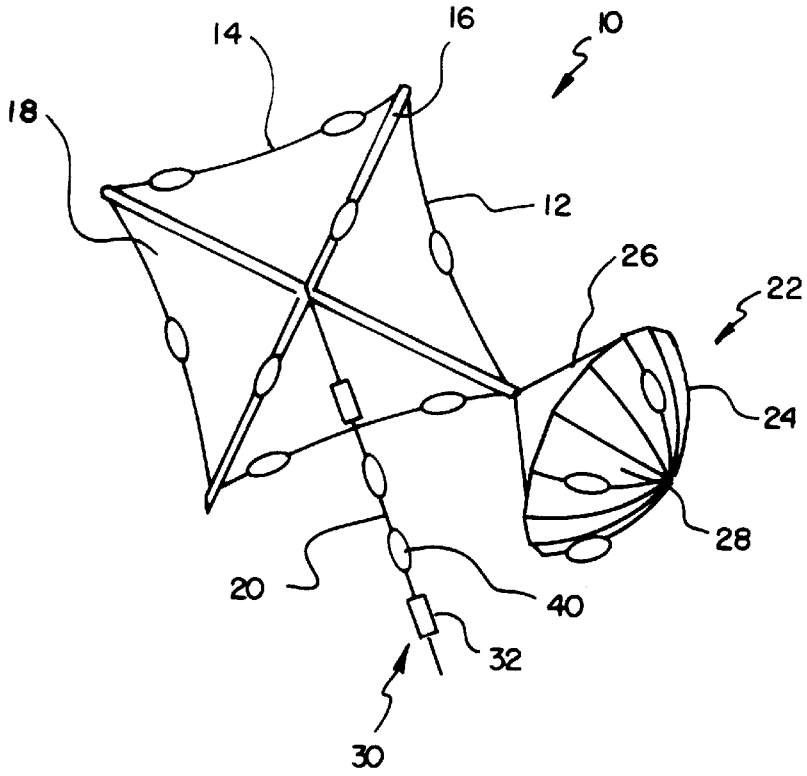
FIG. 1 is a perspective view of a new illuminated kite system according to the present invention.
Figure 2:
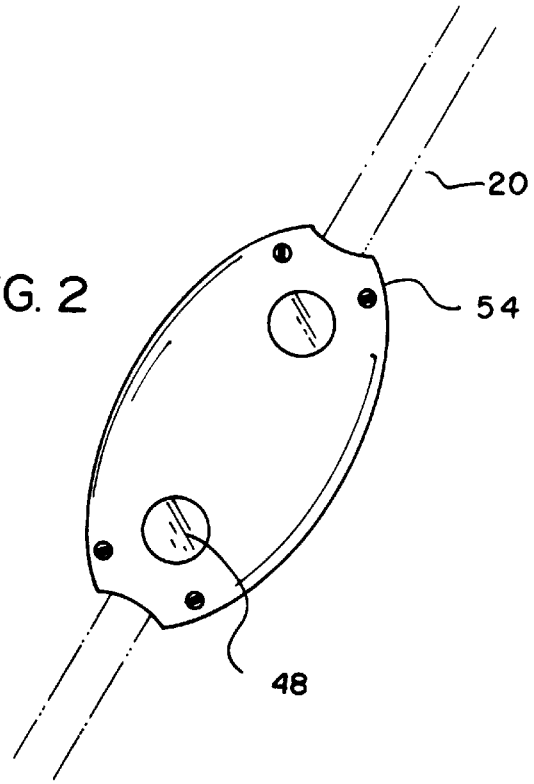
FIG. 2 is a side view of one of the embodiments of the electrical light modules of the present invention.

With reference now to the drawings, and in particular to FIGS. 1 through 8 thereof, a new illuminated kite system embodying the principles and concepts of the present invention and generally designated by the reference numeral 10 will be described.

The present invention, designated as numeral 10, is adapted for use with a kite 12 including a sail portion 14 having a pair of resilient linear rods 16 coupled at central extents thereof and in perpendicular relationship. A planar flexible sheet 18 is mounted on the linear rods for catching wind during use. The kite further includes a nylon guide string 20 having a first end coupled to the central extents of the linear rods. The guide string depends downwardly from the sail portion for being held by a user.

The kite also has a twirling assembly 22 defined by a hemispherical chute 24. As shown in FIG. 1, the hemispherical chute is equipped with a peripheral edge having a plurality of nylon support strings 26 coupled thereto and extending therefrom in a converging manner. Such support strings are coupled with an end of one of the linear rods of the sail portion either directly or by way of a rotating connector such as a swivel. The hemispherical chute has an interior surface lined with a plurality of resilient arcuate rods 28 coupled between the peripheral edge of the hemispherical chute and an apex thereof. During use, the twirling assembly serves to rotate about an axis associated with the resilient rod to which it is attached. This may be accomplished by equipping the chute with a plurality of slits and vanes or by employing any other well known means of effecting a spin during use.

Figure 6:
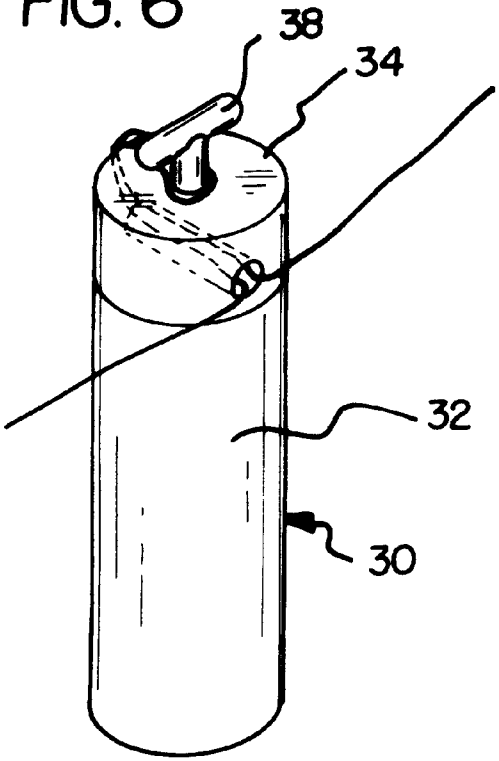
FIG. 6 is a perspective view of the embodiment of the present invention of FIG. 5 during use.
Figure 5:
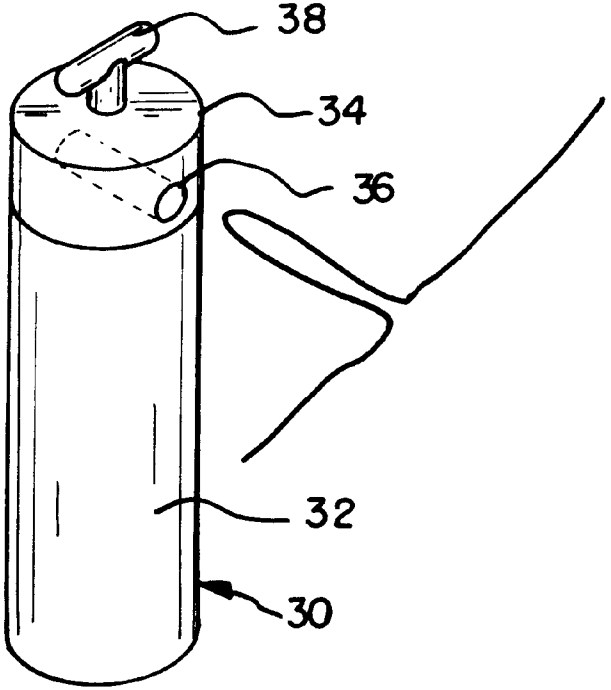
FIG. 5 is a perspective view of another one of the embodiments of the chemilluminescent light units of the present invention.

As shown in FIGS. 5 & 6, a plurality of chemilluminescent light units 30 are provided each including a flexible cylindrical container 32 with a top face, a bottom face and a side wall for defining a closed interior space. Such interior space contains a uniquely colored chemilluminescent material that is activated upon the bending of the container. This may be accomplished by including a glass vial within the container. The top face of the container has a solid disk 34 coupled thereto with a diameter equal to that of the container and a height about ¼ that of the container. The aforementioned disk has a diametrically disposed bore 36 formed therein. Associated therewith is a T-shaped post 38 fixedly coupled to a center of a top surface of the disk. An upper extent of the post preferably resides along an axis perpendicular with respect to the bore.

Figure 4:
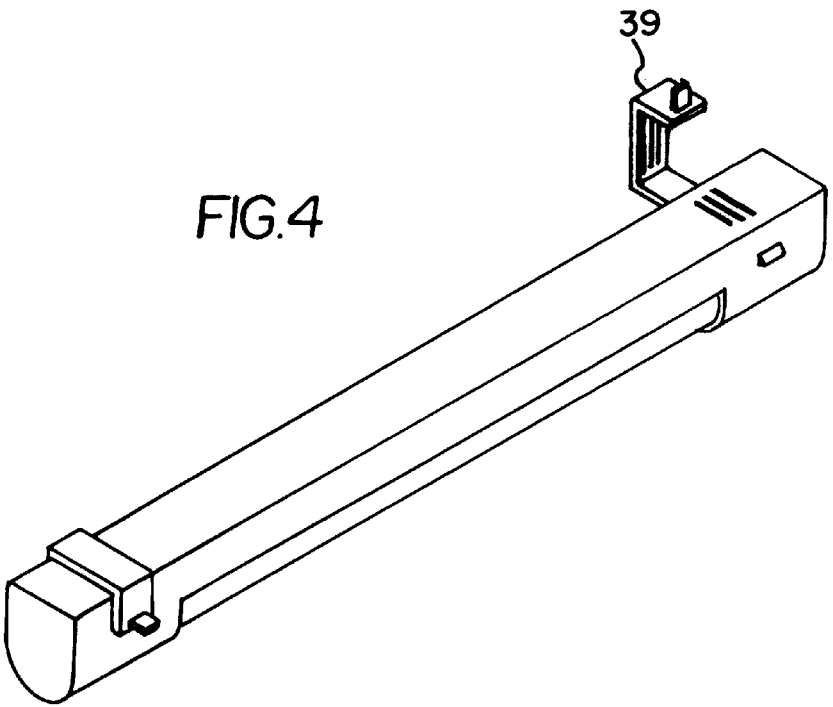
FIG. 4 is a perspective view of one of the embodiments of the chemilluminescent light units of the present invention.
Figure 3:
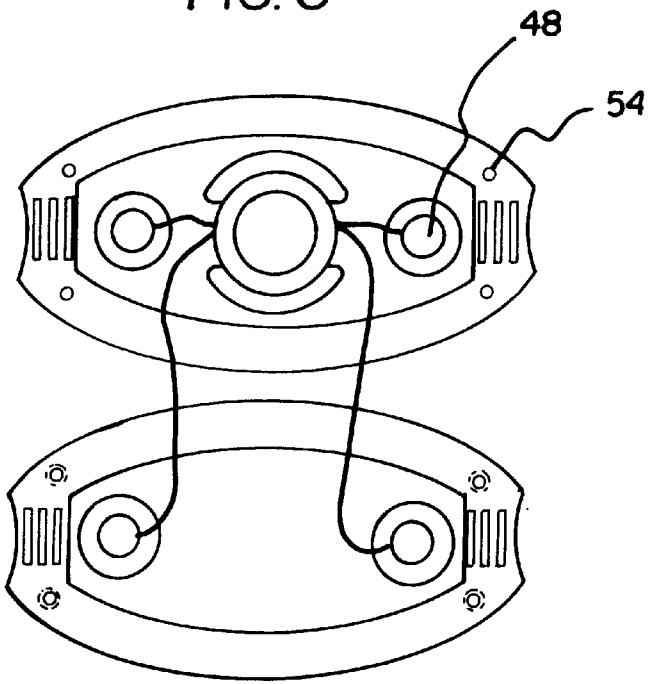
FIG. 3 is an exploded view of one of the embodiments of the electrical light modules that is shown in FIG. 2.

In use, the guide string of the kite is adapted to be slid through the diametrically disposed bore. Thereafter, the guide string is attached about the T-shaped post for spacedly fixing the chemilluminescent light units with respect to the guide string along a length thereof. Note FIG. 6. As such, the containers of the light units depend downwardly free during use. As an option, any other type of containment unit may be used to attach the containers of chemilluminescent material to the string of the kite. For example, dual C-shaped clamps 39 may be used as shown in FIG. 4.

Next provided is a plurality of electrical light modules 40 each including a housing having a ellipsoidal configuration.

Figure 7:
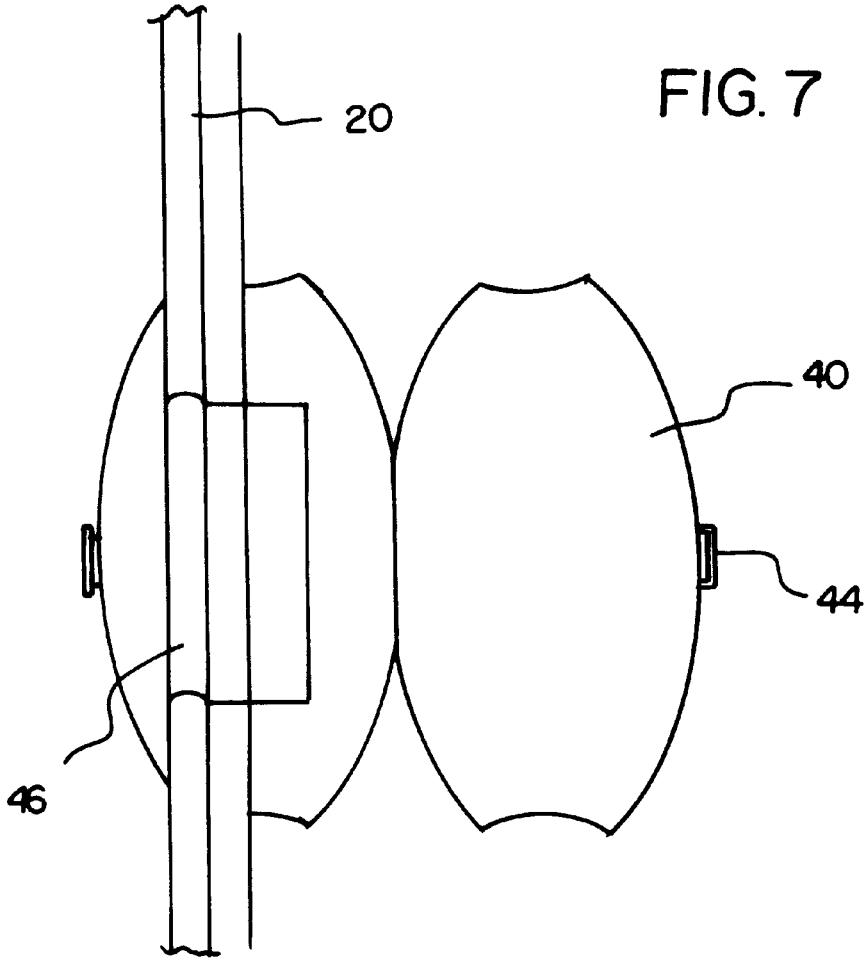
FIG. 7 is a rear view of another embodiment of the electrical light modules of the present invention.
Figure 8:
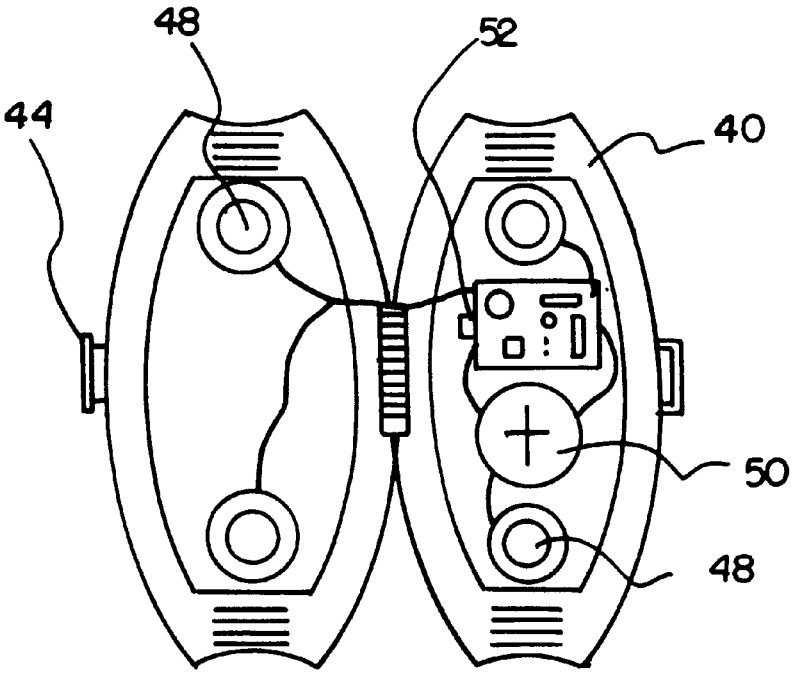
FIG. 8 is a front view of the embodiment of the electrical light modules shown in FIG. 7.

The housing of each light module is halved to define a pair of halves each with an arcuate exterior surface, a planar interior surface and a periphery formed therebetween. As shown in FIG. 7, the halves are hingably coupled along first side edges of the peripheries thereof. Further included is a pair of locking couples 44 mounted on second side edges of the peripheries of the halves. Such locking couples serve for allowing the halves to be opened and closed. As shown in FIGS. 7 & 8, the couples preferably including a male locking latch and a closed female loop which are adapted to matingly engage.

One of the halves of each electrical light module includes a coupling tube 46 mounted along the exterior surface thereof. Such tube may be dimensioned and adapted for frictionally receiving the guide string, the linear rods or the arcuate rods of the kite. As an option, the coupling tube may be uniquely dimensioned for attaching to each of the foregoing components. As shown in FIG. 1, the electrical light modules and the chemilluminescent light units are mounted on the guide string in an alternating fashion.

Each of the halves preferably have a pair of differently colored lights 48 mounted on the planar interior surface thereof. In use, the lights of the electrical light modules are adapted for illuminating intermittently upon actuation. As shown in FIG. 7, one of the halves has a battery 50 mounted on a central extent thereof. Coupled between the battery and the lights is a toggle switch 52 for selectively actuating the lights. When actuated, it is optimal that the halves be opened to allow the emission of the light. Ideally, each of the foregoing components of the halves are recessed within the interior surface of the associated half in order to allow the halves to be closed in tight abutment.

As an option, the halves of the present embodiment may be free with respect to each other. Note FIGS. 2 & 3. In such embodiment, threaded bores 54 are formed adjacent to the ends of the halves for accepting screws to maintain the interior surfaces in abutment during use. It should be noted that the lights of the present embodiment are mounted on the exterior surface as opposed to the interior surface of the previous embodiment.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An illuminated kite system comprising, in combination:

a kite including a sail portion having a pair of resilient linear rods coupled at central extents thereof and in perpendicular relationship and a planar flexible sheet mounted on the linear rods for catching wind, the kite further including a nylon guide string having a first end coupled to the central extents of the linear rods and depending downwardly therefrom for being held by a user, the kite further including a twirling assembly defined by a hemispherical chute with a peripheral edge having a plurality of nylon support strings coupled thereto and extending therefrom in a converging manner to couple with an end of one of the linear rods of the sail portion, the hemispherical chute having an interior surface lined with a plurality of resilient arcuate rods coupled between the peripheral edge of the hemispherical chute and an apex thereof, wherein the twirling assembly is adapted to rotate during use;

a plurality of chemiluminescent light units each including a flexible cylindrical container with a top face, a bottom face and a side wall for defining a closed interior space in which a chemiluminescent material is stored and activated upon the bending of the container, the top face of the container having a disk coupled thereto with a diameter equal to that of the container and a height about ¼ that of the container, the disk having a diametrically disposed bore formed therein and a T-shaped post fixedly coupled to a center of a top surface thereof, wherein the guide string of the kite is adapted to be slid through the diametrically disposed bore and attached about the T-shaped post for spacedly fixing the chemiluminescent light units with respect to the guide string along a length thereof; and a plurality of electrical light modules each including a housing having a ellipsoidal configuration halved to define a pair of halves each having an arcuate exterior surface, a planar interior surface and a periphery formed therebetween, the halves being hinge ably coupled along first side edges of the peripheries thereof and further including a pair of locking couples mounted on second side edges of the peripheries thereof for allowing the halves to be opened and closed, one of the halves including a coupling tube mounted along the exterior surface thereof for frictionally receiving the guide string, the linear rods and the arcuate rods of the kite, each of the halves including a pair of differently colored lights mounted on the planar interior surface thereof at the foci thereof for illuminating intermittently upon the actuation thereof, one of the halves having a battery mounted on a central extent thereof and a toggle switch coupled between the battery and the lights for selectively actuating the lights.

2. A kite illumination system comprising:

a kite having a sail portion and a string, the sail having a plurality of edges;

a plurality of self-contained light modules, each light module including a container, the container comprising two shell portions releasably mounted together to define an interior, a power source being mounted in the interior and completely housed in the container, and a light source powered by the power source, the light source being mounted in the interior and being completely housed in the container, the container having a passage through the interior of the container;

wherein the passage of each light module is adapted to receive a portion of the string of the kite for securing the container to the string at a user-selectable location.

3. A kite illumination system as set forth in claim 2, wherein the shell portions are hingably coupled and include a lock for selectively locking the same in a closed orientation.

4. A kite illumination system as set forth in claim 2, additionally comprising attachment means and wherein the attachment means includes a tube mounted on one of the shell portions for receiving the string of the kite.

5. An illuminated kite system comprising:

a kite including a sail portion having a pair of resilient rods coupled at central extents thereof and in perpendicular relationship and a flexible sheet mounted on the rods for catching wind, the kite further including a guide string having a first end coupled to the central extents of the rods and depending downwardly therefrom for being held by a user, the kite further including a twirling assembly defined by a chute with a peripheral edge having a plurality of support strings coupled thereto and extending therefrom in a converging manner to couple with an end of one of the rods of the sail portion, the chute having an interior surface lined with a plurality of resilient rods coupled between the peripheral edge of the chute and an apex thereof, wherein the twirling assembly is adapted to rotate during use;

a plurality of chemiluminescent light units each including a flexible container with a top face, a bottom face and a side wall for defining a closed interior space in which a chemiluminescent material is stored and activated upon the bending of the container, the top face of the container having a disk coupled thereto, the disk having a diametrically disposed bore formed therein and a post fixedly coupled to a center of a top surface thereof, wherein the guide string of the kite is adapted to be slid through the diametrically disposed bore and attached about the post for spacedly fixing the chemiluminescent light units with-respect to the guide string along a length thereof; and a plurality of electrical light modules each including a housing having a configuration halved to define a pair of halves each having an exterior surface, an interior surface and a periphery formed therebetween, the halves being hingably coupled along first side edges of the peripheries thereof and further including a pair of locking couples mounted on second side edges of the peripheries thereof for allowing the halves to be opened and closed, one of the halves including a coupling tube mounted along the exterior surface thereof for frictionally receiving the guide string, the rods of the sail portion and the rods of the chute portion of the kite, each of the halves including a pair of differently colored lights mounted on the interior surface thereof at the foci thereof for illuminating intermittently upon the actuation thereof, one of the halves having a battery mounted on a central extent thereof and a toggle switch coupled between the battery and the lights for selectively actuating the lights.

* * * * *